US010731875B2

(12) United States Patent
Onuki et al.

(10) Patent No.: US 10,731,875 B2
(45) Date of Patent: Aug. 4, 2020

(54) OUTDOOR UNIT OF AIR-CONDITIONING APPARATUS

(71) Applicant: Mitsubishi Electric Corporation, Tokyo (JP)

(72) Inventors: Ryozo Onuki, Tokyo (JP); Shinichi Uchino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 71 days.

(21) Appl. No.: 16/080,799

(22) PCT Filed: May 12, 2016

(86) PCT No.: PCT/JP2016/064174

§ 371 (c)(1),
(2) Date: Aug. 29, 2018

(87) PCT Pub. No.: WO2017/195335

PCT Pub. Date: Nov. 16, 2017

(65) Prior Publication Data

US 2019/0145637 A1 May 16, 2019

(51) Int. Cl.
*F24F 1/14* (2011.01)
*F24F 1/56* (2011.01)
(Continued)

(52) U.S. Cl.
CPC ..... *F24F 1/56* (2013.01); *F24F 1/14* (2013.01); *F24F 1/24* (2013.01); *F24F 1/48* (2013.01)

(58) Field of Classification Search
CPC ..... F24F 1/26; F24F 1/32; F24F 1/34; F24F 1/14; F24F 1/24; F24F 1/48; F24F 1/56
See application file for complete search history.

(56) References Cited

U.S. PATENT DOCUMENTS

2009/0081940 A1* 3/2009 Jang ..... F24F 1/22 454/184
2010/0175407 A1* 7/2010 Kim ..... F04D 29/541 62/285

(Continued)

FOREIGN PATENT DOCUMENTS

CN 204612007 U 9/2015
JP S60-083868 U 6/1985

(Continued)

OTHER PUBLICATIONS

Office action dated Jun. 25, 2019 issued in corresponding JP patent application No. 2018-516299 (and English translation thereof).

(Continued)

*Primary Examiner* — Filip Zec
(74) *Attorney, Agent, or Firm* — Posz Law Group, PLC

(57) ABSTRACT

An air-conditioning-apparatus outdoor unit includes a casing, an air-sending device chamber, a machine chamber, a partition, a heat exchanger cover, and an electric box including a bottom plate that defines a bottom surface of the electric box and that is joined to an upper end of the heat exchanger cover. The casing includes a shell panel having an outdoor-air inlet that is open. The heat exchanger cover is positioned to face the outdoor-air inlet, and defines, together with the partition and the shell panel, an air passage communicating with the outdoor-air inlet in the machine chamber. The bottom plate of the electric box has a bottom opening communicating with the air passage.

4 Claims, 4 Drawing Sheets

(51) Int. Cl.
*F24F 1/24* (2011.01)
*F24F 1/48* (2011.01)

(56) References Cited

U.S. PATENT DOCUMENTS

| | | | | |
|---|---|---|---|---|
| 2015/0198339 | A1* | 7/2015 | Jeon | F24F 1/48<br>62/259.2 |
| 2015/0316279 | A1* | 11/2015 | Kubono | F24F 1/56<br>62/515 |
| 2016/0258636 | A1* | 9/2016 | Kim | F24F 1/38 |
| 2016/0348927 | A1* | 12/2016 | Endo | F24F 1/22 |

FOREIGN PATENT DOCUMENTS

| | | | |
|---|---|---|---|
| JP | S63-010421 | Y2 | 3/1988 |
| JP | S63-032239 | U | 3/1988 |
| JP | H02-115634 | A | 4/1990 |
| JP | H03-073843 | U | 7/1991 |
| JP | H03-118444 | U | 12/1991 |
| JP | H05-79661 | A | 3/1993 |

OTHER PUBLICATIONS

International Search Report of the International Searching Authority dated Aug. 2, 2016 for the corresponding international application No. PCT/JP2016/064174 (and English translation).
Extended European Search Report dated Apr. 24, 2019 issued in corresponding EP patent application No. 16901683.9.
Office Action dated Apr. 26, 2020 issued in corresponding CN patent application No. 201680085405.7 (and English translation).

* cited by examiner

OUTDOOR UNIT OF AIR-CONDITIONING APPARATUS

CROSS REFERENCE TO RELATED APPLICATION

This application is a U.S. national stage application of International Application No. PCT/JP2016/064174, filed on May 12, 2016, the contents of which are incorporated herein by reference.

TECHNICAL FIELD

The present invention relates to an air-conditioning-apparatus outdoor unit including a casing and a partition disposed in the casing.

BACKGROUND

A typical outdoor unit has an air-sending chamber accommodating a heat exchanger and an air-sending device and a machine chamber accommodating a compressor and an electric component, and the air-sending chamber is separated from the machine chamber by a partition. In such an outdoor unit, the compressor and the electric component emit heat in the machine chamber. To dissipate heat from the compressor and the electric component, some of such outdoor units include a shell panel in a casing of the outdoor unit having an air inlet through which outdoor air is sucked into the machine chamber (refer to Patent Literature 1, for example).

PATENT LITERATURE

Patent Literature 1: Japanese Examined Utility Model Registration Application Publication No. 63-010421

An air-conditioning apparatus disclosed in Patent Literature 1 includes a front panel located in a space from which an air-sending device sucks air, and the front panel has an air inlet. When it rains, for example, rainwater may enter the outdoor unit and lead to corrosion of structural parts in the outdoor unit or a short circuit in the electric component disposed in the outdoor unit.

SUMMARY

The present invention aims to overcome the above-described disadvantages and provide an air-conditioning-apparatus outdoor unit that has an air inlet for sucking air for a machine chamber and that prevents, for example, corrosion of structural parts in the outdoor unit and a short circuit in an electric component disposed in the outdoor unit.

An air-conditioning-apparatus outdoor unit according to an embodiment of the present invention includes a casing constituting a shell of the outdoor unit, an air-sending device chamber disposed in the casing and accommodating a heat exchanger and an air-sending device, a machine chamber disposed in the casing and accommodating a compressor, a partition separating the air-sending device chamber from the machine chamber, a heat exchanger cover having an L-shaped cross section and including a first flat portion that defines a first side wall of the heat exchanger cover and that is joined to the partition and a second flat portion that defines a second side wall of the heat exchanger cover and that is joined to the casing, and an electric box including a bottom plate that defines a bottom surface of the electric box and that is joined to an upper end of the heat exchanger cover.

The casing includes a shell panel having an outdoor-air inlet that is open. The heat exchanger cover is positioned to face the outdoor-air inlet, and defines, together with the partition and the shell panel, an air passage communicating with the outdoor-air inlet in the machine chamber. The bottom plate of the electric box has a bottom opening communicating with the air passage.

In an air-conditioning-apparatus outdoor unit according to an embodiment of the present invention, the casing includes the shell panel having the outdoor-air inlet that is open and positioned to face a pipe on one end of the heat exchanger. The heat exchanger cover is positioned to face the pipe and the outdoor-air inlet. This configuration enables outdoor air to be sucked into the machine chamber, and minimizes the entry of rainwater to prevent, for example, corrosion of structural parts in the machine chamber and a short circuit in an electric component disposed in the machine chamber.

DETAILED DESCRIPTION

An outdoor unit 100 of an air-conditioning apparatus in the present invention will be described below in detail with reference to the drawings. Note that the relative sizes of components illustrated in the following figures may differ from the actual sizes of the components. Furthermore, note that components denoted by the same reference sings in the following figures are the same components or equivalents. This note applies to the following description of the specification. Furthermore, note that the forms of components described in the specification are illustrative only, and the forms of components are not limited to those in the descriptions.

Embodiment 1

Figure 1:
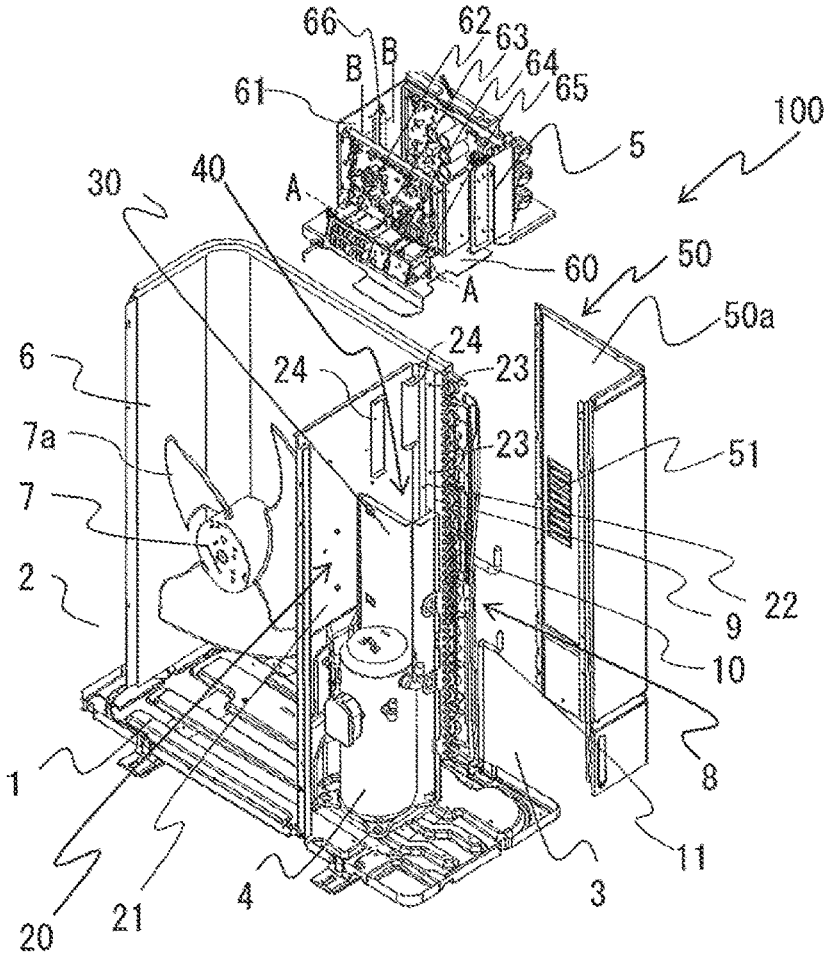
FIG. 1 is a schematic perspective view illustrating the inside of an air-conditioning-apparatus outdoor unit according to Embodiment 1 of the present invention.

FIG. 1 is a schematic perspective view illustrating the inside of the air-conditioning-apparatus outdoor unit according to Embodiment 1 of the present invention. As illustrated in FIG. 1, the inside of the outdoor unit 100 is divided into an air-sending device chamber 2 and a machine chamber 3 by a partition 20. The outdoor unit 100 includes a shell panel

50*a*, serving as part of a casing 50 included in a body of the outdoor unit 100. The air-sending device chamber 2 accommodates, for example, a heat exchanger 6 and an air-sending device 7. The machine chamber 3 accommodates, for example, a compressor 4, a refrigerant pipe (not illustrated), and an electric box 5. The inside of the machine chamber 3 is divided into sections by a heat exchanger cover 30, thus forming an air passage 40. The compressor 4 and the heat exchanger 6 are installed on a bottom plate 1.

The partition 20 includes a vertical portion 21 upwardly extending from the bottom plate 1 and provided between a front panel of the outdoor unit 100 and the heat exchanger 6 and an angled portion 22 angled from an end of one of long sides of the vertical portion 21 toward the machine chamber 3. The partition 20 is formed by bending, for example, a metal sheet. The angled portion 22 has screw holes 23, which are through-holes. The screw holes 23 may be blind holes, such as recesses. The partition 20 has communication openings 24, through which the air-sending device chamber 2 communicates with the machine chamber 3, in upper part of the partition 20. In FIG. 1, the partition 20 has two communication openings 24. The partition 20 may have one communication opening.

The heat exchanger 6 allows heat exchange between outdoor air and refrigerant, acts as an evaporator during a heating operation, and acts as a condenser during a cooling operation. The heat exchanger 6 includes heat transfer tubes, through which the refrigerant passes, and fins for increasing the area of heat transfer between the outdoor air and the refrigerant flowing through the heat transfer tubes. The heat exchanger 6 is L-shaped in such a manner that the heat exchanger 6 includes flat portions and a curved portion. Although the L-shaped heat exchanger 6 is illustrated as an example, the heat exchanger 6 may be flat or may be U-shaped and include curved portions in both ends of the heat exchanger 6. The heat exchanger 6 includes heat exchanger pipes 8, serving as heat transfer tubes, protruding toward the machine chamber 3 and a heat exchanger end plate 9, through which the heat exchanger pipes 8 extend, disposed on a first end of the heat exchanger 6. The heat exchanger 6 further includes an inlet pipe 10 and an outlet pipe 11 protruding from the first end toward the machine chamber 3. The inlet pipe 10 is connected to a discharge pipe connected to the compressor 4, and the outlet pipe 11 is connected to an expansion pipe of an expansion unit, thus forming a refrigerant circuit. When the flow of the refrigerant is reversed, the inlet pipe 10 is connected to the expansion pipe of the expansion unit, and the outlet pipe 11 is connected to the discharge pipe.

The air-sending device 7 is an air-sending unit including a propeller fan 7*a* and a motor, and produces air circulation for efficient heat exchange. The air-sending device 7 has a function of sucking the outdoor air into the outdoor unit 100 from a rear of the outdoor unit 100 and discharging the outdoor air sucked into the outdoor unit 100 toward a front of the outdoor unit 100. The air-sending device 7 further has a function of creating a negative pressure in a space defined by the heat exchanger 6 and the propeller fan 7*a* and directing the outdoor air sucked from an outdoor-air inlet 51 in the shell panel 50*a* to the electric box 5 via the air passage 40.

The compressor 4 is, for example, a rotary type, scroll type, or vane type compressor whose capacity can be controlled by driving the compressor under control of an inverter. The compressor 4 compresses sucked refrigerant into high-temperature, high-pressure gas refrigerant and discharges the refrigerant.

The electric box 5 accommodates control components for controlling an operation of the outdoor unit 100. Examples of the control components include hardware, such as a circuit device, implementing such a function, software to run on a microcomputer or an arithmetic unit, such as a central processing unit, and a combination of hardware and software. The electric box 5 includes a bottom plate 60 defining a bottom surface of the electric box 5 and a first side plate 61 defining a side surface facing the partition 20. The bottom plate 60 has a bottom opening 62, a bottom opening 63, a bottom opening 64, and a bottom opening 65, which communicate with the air passage 40. The first side plate 61 has a side vent 66, which is open and communicates with the communication openings 24 of the partition 20.

Figure 2:
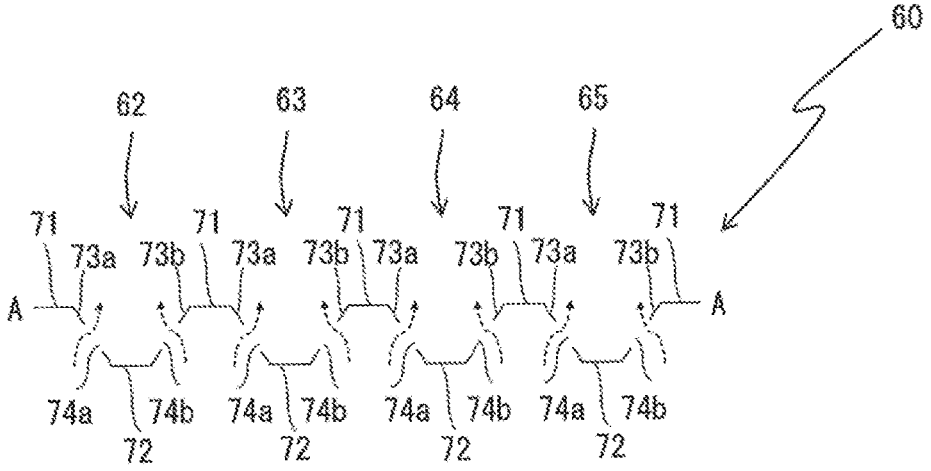
FIG. 2 is a sectional view taken along the line A-A in FIG. 1.

FIG. 2 is a sectional view taken along the line A-A in FIG. 1. In FIG. 2, dotted-line arrows indicate the flow of air. As the bottom opening 62, the bottom opening 63, the bottom opening 64, and the bottom opening 65 have the same structure, only the bottom opening 62 will be described. As illustrated in FIG. 2, the bottom plate 60 has the bottom opening 62, and the bottom opening 62 includes step portions protruding toward the air passage 40. The bottom opening 62 includes an interstep portion 73*a* and an interstep portion 73*b*, which each are angled from a first bottom portion 71 to a second bottom portion 72. The interstep portion 73*a* has an opening 74*a*, and the interstep portion 73*b* has an opening 74*b*. In other words, the bottom plate 60 has a plurality of protruding parts on its lower surface when the bottom plate 60 is viewed as a horizontal plane.

Figure 3:
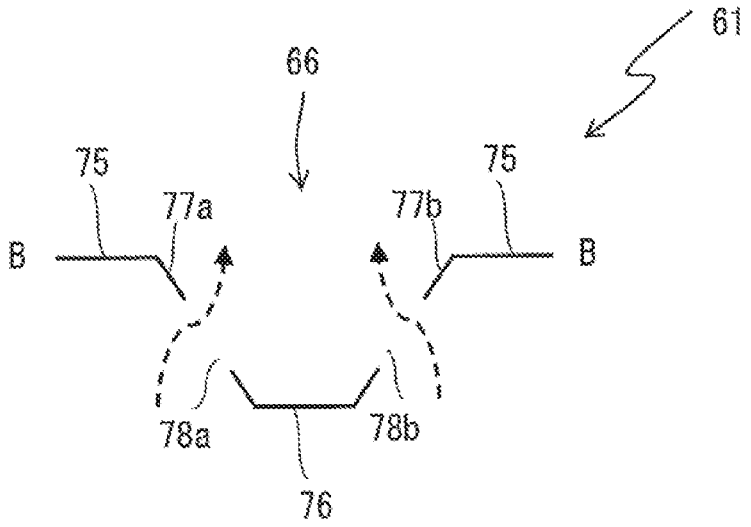
FIG. 3 is a sectional view taken along the line B-B in FIG. 1.

FIG. 3 is a sectional view taken along the line B-B in FIG. 1. In FIG. 3, dotted-line arrows indicate the flow of air. The first side plate 61 has the side vent 66, and the side vent 66 includes a step portion protruding away from the partition 20. The side vent 66 includes an interstep portion 77*a* and an interstep portion 77*b*, which each are angled from a first side portion 75 to a second side portion 76. The interstep portion 77*a* has an opening 78*a*, and the interstep portion 77*b* has an opening 78*b*.

Figure 4:
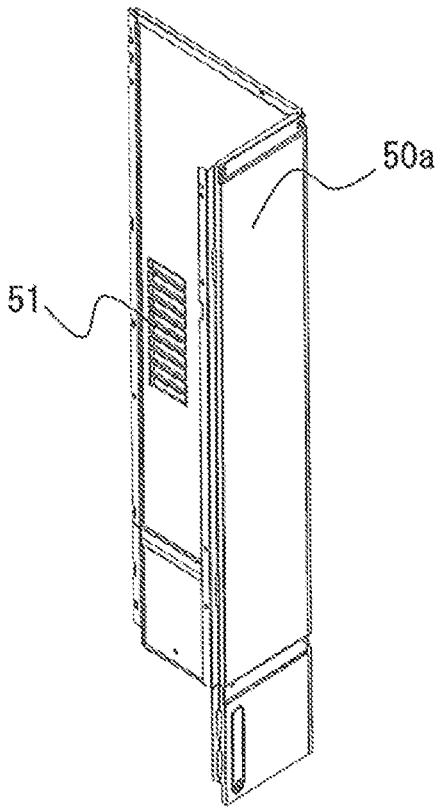
FIG. 4 is a perspective view of a shell panel constituting part of a casing of the air-conditioning-apparatus outdoor unit according to Embodiment 1 of the present invention.
Figure 5:
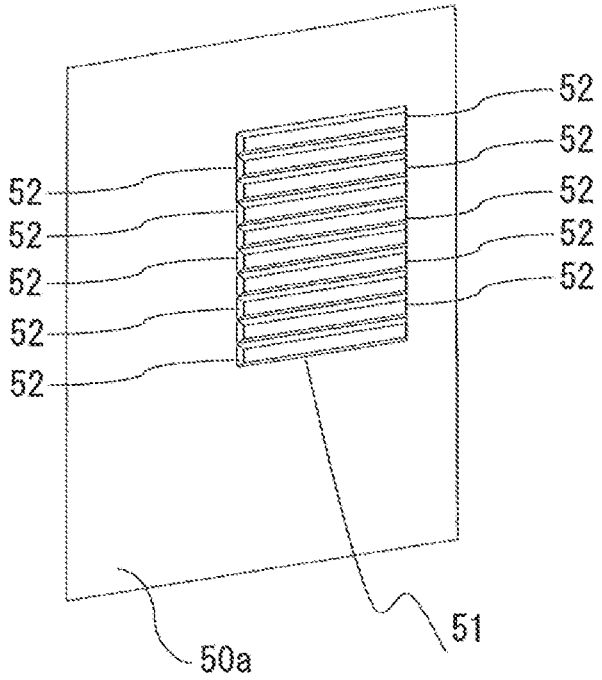
FIG. 5 is an enlarged perspective view illustrating an outdoor-air inlet as viewed from the outside of the casing of the air-conditioning-apparatus outdoor unit according to Embodiment 1 of the present invention.

FIG. 4 is a perspective view of the shell panel constituting part of the casing of the air-conditioning-apparatus outdoor unit according to Embodiment 1 of the present invention. FIG. 5 is an enlarged perspective view illustrating the outdoor-air inlet as viewed from the outside of the casing of the air-conditioning-apparatus outdoor unit according to Embodiment 1 of the present invention. The shell panel 50*a* is made of a plate, such as a steel sheet, extending in a height direction of the outdoor unit and has an L-shaped cross section. As illustrated in FIG. 4, the shell panel 50*a* has the outdoor-air inlet 51 for sucking the outdoor air. The outdoor-air inlet 51 is open and positioned to face the heat exchanger pipes 8 on the first end of the heat exchanger 6. As illustrated in FIG. 5, the outdoor-air inlet 51 includes a plurality of truncated pyramid-shaped protrusions 52 outwardly protruding from the shell panel 50*a*. The outermost part of each protrusion 52 is open. The outside and inside of the outdoor unit 100 communicate with each other through the open outermost part of the protrusion 52. Although ten protrusions 52 are arranged in FIG. 5, any number of protrusions 52 may be arranged. Although each protrusion 52 is truncated pyramid-shaped, the protrusion 52 may be, for example, truncated cone-shaped, hemispherical shaped, cylinder-shaped, or prism-shaped.

Figure 6:
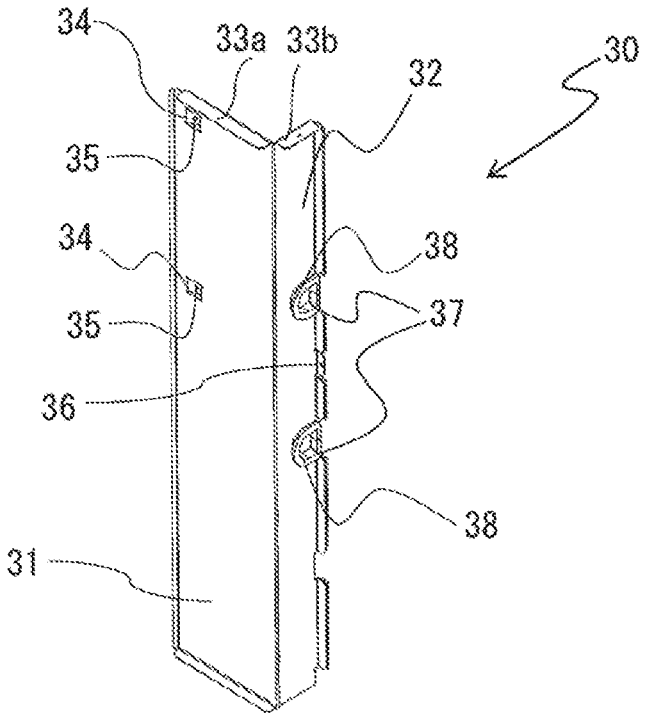
FIG. 6 is a perspective view of a heat exchanger cover of the air-conditioning-apparatus outdoor unit according to Embodiment 1 of the present invention.

FIG. 6 is a perspective view of the heat exchanger cover of the air-conditioning-apparatus outdoor unit according to Embodiment 1 of the present invention. The heat exchanger cover 30 is made of a plate, such as a steel sheet, extending in the height direction of the outdoor unit and has an L-shaped cross section. The heat exchanger cover 30 includes a first flat portion 31, which defines a wide side wall in the L-shaped cross section and faces the heat exchanger pipes 8 and the outdoor-air inlet 51, and a second flat portion 32, which defines a narrow side wall in the L-shaped cross section and connects to the first flat portion 31.

The heat exchanger cover 30 includes a plate 34 disposed at an upper end position of a side end of the first flat portion 31 in a height direction of the side end and another plate 34 disposed at an intermediate position of the side end in the height direction of the side end. The plates 34 are angled inward in the L-shaped cross section. The plates 34 each have a screw hole 35, through which a screw extends. These screws extend through the screw holes 23 of the partition 20 and are secured to the heat exchanger end plate 9. Consequently, the heat exchanger cover 30 is joined and fixed to the partition 20 and the heat exchanger 6. The heat exchanger cover 30 further has a screw hole 36 at an intermediate position of a side end of the second flat portion 32 in a height direction of the side end. A screw extends through the screw hole 36 and is secured to the shell panel 50*a*. Consequently, the heat exchanger cover 30 is joined and fixed to the shell panel 50*a*. The heat exchanger cover 30 is positioned to face the heat exchanger pipes 8 and the outdoor-air inlet 51. The heat exchanger cover 30 partially covers the heat exchanger pipes 8, and defines, together with the partition 20, the heat exchanger 6, and the shell panel 50*a*, the air passage 40 communicating with the outdoor-air inlet 51 in the machine chamber 3.

The heat exchanger cover 30 further has two U-shaped pipe openings 37 at intermediate positions of the side end of the second flat portion 32 in the height direction of the side end. The pipe openings 37 receive pipe holders 38, each through which a corresponding one of the inlet pipe 10 and the outlet pipe 11 extends.

The heat exchanger cover 30 includes a first upper end 33*a*, formed by bending upper end part of the first flat portion 31 outwardly in the L-shaped cross section, and a second upper end 33*b*, formed by bending upper end part of the second flat portion 32 outwardly in the L-shaped cross section. The electric box 5 is connected and fixed to the first upper end 33*a* and the second upper end 33*b*.

Figure 7:
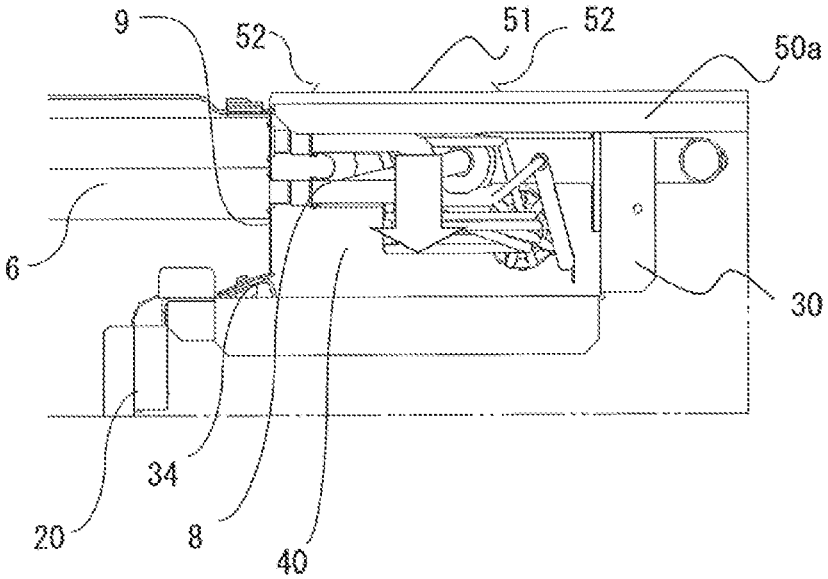
FIG. 7 is a transverse sectional view of essential part of the air-conditioning-apparatus outdoor unit according to Embodiment 1 of the present invention.
Figure 8:
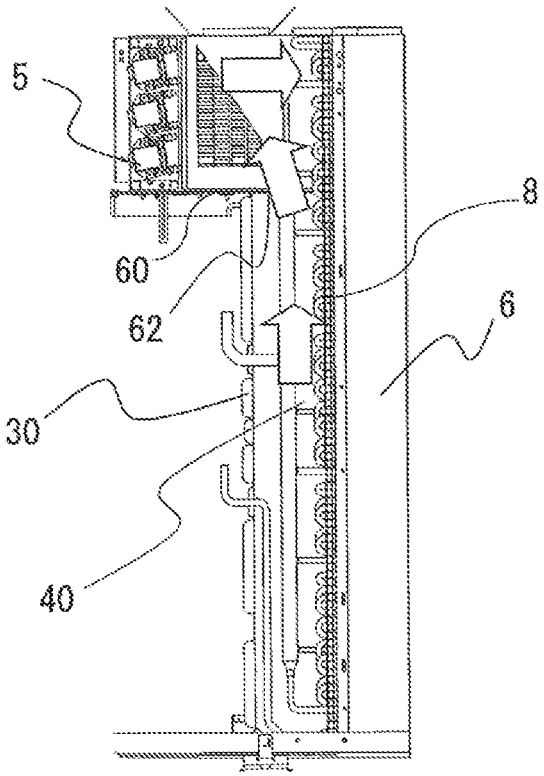
FIG. 8 is a longitudinal sectional view of essential part of the air-conditioning-apparatus outdoor unit according to Embodiment 1 of the present invention.

FIG. 7 is a transverse sectional view of essential part of the air-conditioning-apparatus outdoor unit according to Embodiment 1 of the present invention. FIG. 8 is a longitudinal sectional view of essential part of the air-conditioning-apparatus outdoor unit according to Embodiment 1 of the present invention. The flow of air in the outdoor unit 100 will be described below with reference to FIGS. 1, 7, and 8. In FIGS. 7 and 8, outlined arrows indicate the flow of outdoor air.

Activation of the air-sending device 7 creates a negative pressure in a space defined by the air-sending device 7 and the heat exchanger 6 in the air-sending device chamber 2. The communication openings 24 in the partition 20 communicate with the side vent 66 in the first side plate 61 of the electric box 5, and, for example, the bottom opening 62 in the bottom plate 60 of the electric box 5 communicates with the air passage 40, so that the space under the negative pressure in the air-sending device chamber 2 communicates with the outdoor-air inlet 51. Consequently, the negative pressure in the space defined by the air-sending device 7 and the heat exchanger 6 in the air-sending device chamber 2 causes the outdoor air to be sucked into the air passage 40 through the outdoor-air inlet 51. The outdoor air sucked into the air passage 40 is drawn to the electric box 5 disposed on the heat exchanger cover 30 and is sucked into the electric box 5 through, for example, the bottom opening 62 in the bottom plate 60 of the electric box 5. The outdoor air, sucked into the electric box 5, cools electric components while passing through the inside of the electric box 5. Subsequently, the outdoor air sucked into the electric box 5 is sucked into the air-sending device chamber 2 through the side vent 66 located in the first side plate 61 of the electric box 5 and the communication openings 24 located in the partition 20. The outdoor air sucked into the air-sending device chamber 2 is sent to the outside of the outdoor unit 100 by the air-sending device 7.

As described above, the heat exchanger cover 30 defining the air passage regulates the air flow, thus allowing the outdoor air to efficiently flow to the electric box 5. Unfortunately, the outdoor-air inlet 51, serving as an outdoor-air intake, may serve as an entrance for water, such as rain. For this reason, the outdoor unit 100 includes the heat exchanger cover 30. As the heat exchanger cover 30 is positioned to face the heat exchanger pipes 8 and the outdoor-air inlet 51, the heat exchanger cover 30 covers the heat exchanger pipes 8 and the outdoor-air inlet 51 and thus minimizes the entry of rainwater. This configuration can prevent, for example, electric components and wiring lines in the machine chamber 3 from getting wet, thus preventing, for example, corrosion of structural parts in the machine chamber 3 and a short circuit in the electric components in the machine chamber 3.

The outdoor-air inlet 51 in the shell panel 50*a* includes the protrusions 52. The protrusions 52, each serving as a canopy, can minimize the entry of rain.

In addition, the heat exchanger cover 30 defining the air passage regulates the flow of air, thus allowing the outdoor air to efficiently flow to the electric box 5. Specifically, a traditional air-conditioning-apparatus outdoor unit may fail to sufficiently cool an electric box because an inlet to suck air for cooling electric components is located at a distance from the electric box and the air fails to flow properly. The heat exchanger cover 30, which covers and surrounds the pipes of the heat exchanger and defines the air passage for cooling the electric components, enables the air to efficiently flow to the electric box.

Furthermore, the heat exchanger cover 30 covering and surrounding the heat exchanger pipes 8 allows the outdoor air flowing through the air passage 40 to contact the heat exchanger pipes 8, thus achieving heat exchange between the outdoor air and the heat exchanger pipes 8. This configuration maximizes the capacity of the heat exchanger 6, thus enhancing the performance of the air-conditioning apparatus.

Embodiments of the present invention are not limited to Embodiment 1 described above. For example, although the bottom plate 60 has the four bottom openings, that is, the bottom opening 62, the bottom opening 63, the bottom opening 64, and the bottom opening 65, the bottom plate 60 may have one bottom opening or may have a plurality of bottom openings. Furthermore, although the bottom opening 62 includes the step portion protruding toward the air passage 40 and the interstep portions each have an opening, the bottom opening 62 may be a slit with no step portion. In addition, although the shell panel 50*a* is made of a plate, such as a steel sheet, extending in the height direction and has an L-shaped cross section, the shell panel 50*a* may be a flat plate defining one side surface of the casing 50. Furthermore, although the outdoor-air inlet 51 includes the plurality of protrusions 52 protruding outwardly from the shell panel 50*a*, the outdoor-air inlet 51 may include flat slits.

The invention claimed is:

1. An outdoor unit of an air-conditioning apparatus, the outdoor unit comprising:

a casing constituting a shell of the outdoor unit;

an air-sending device chamber disposed in the casing, the air-sending device chamber accommodating a heat exchanger and an air-sending device;

a machine chamber disposed in the casing, the machine chamber accommodating a compressor;

a partition separating the air-sending device chamber from the machine chamber;

a heat exchanger cover having an L-shaped cross section to cover and surround heat exchanger pipes and including a first flat portion defining a first side wall of the heat exchanger cover and a second flat portion defining a second side wall of the heat exchanger cover, the first flat portion being joined to the partition, the second flat portion being joined to the casing; and an electric box including a bottom plate defining a bottom surface of the electric box, the bottom plate being joined to an upper end of the heat exchanger cover, the casing including a shell panel having an outdoor-air inlet that is open, the heat exchanger cover being positioned to face the outdoor-air inlet, and defining, together with the partition and the shell panel, an air passage communicating with the outdoor-air inlet in the machine chamber, the bottom plate of the electric box having a bottom opening communicating with the air passage, the partition having a communication opening, through which the air-sending device chamber communicates with the machine chamber, in upper part of the partition, the electric box including a first side plate defining a side wall of the electric box, the first side plate having a side vent that is open and positioned to face the communication opening.

2. The outdoor unit of an air-conditioning apparatus of claim 1, wherein the outdoor-air inlet of the shell panel is positioned to face a pipe on one end of the heat exchanger, and wherein the heat exchanger cover is positioned to face the pipe.

3. The outdoor unit of an air-conditioning apparatus of claim 1, wherein the heat exchanger cover has pipe openings each through which a corresponding one of an inlet pipe and an outlet pipe extends, the inlet pipe and the outlet pipe each connecting the heat exchanger to the compressor.

4. The outdoor unit of an air-conditioning apparatus of claim 1, wherein the shell panel includes a protrusion protruding outwardly from the casing, and the outdoor-air inlet is disposed in the protrusion.

* * * * *